US012251596B1

(12) United States Patent
Guity

(10) Patent No.: US 12,251,596 B1
(45) Date of Patent: Mar. 18, 2025

(54) WEIGHTLIFTING APPARATUS

(71) Applicant: Nazim Guity, Hopewell Junction, NY (US)

(72) Inventor: Nazim Guity, Hopewell Junction, NY (US)

( * ) Notice: Subject to any disclaimer, the term of this patent is extended or adjusted under 35 U.S.C. 154(b) by 0 days.

(21) Appl. No.: 18/889,633

(22) Filed: Sep. 19, 2024

(51) Int. Cl.
*A63B 21/00* (2006.01)

(52) U.S. Cl.
CPC ..... *A63B 21/4009* (2015.10)

(58) Field of Classification Search
CPC ..... A63B 21/4009
See application file for complete search history.

(56) References Cited

U.S. PATENT DOCUMENTS 4,348,774 A 9/1982 Woodson
4,627,109 A 12/1986 Carabelli et al.
4,968,027 A 11/1990 Anderson
4,991,573 A 2/1991 Miller
5,129,647 A * 7/1992 Castellanos ..... A63B 21/0552 482/139
5,207,635 A 5/1993 Richards et al.
D554,268 S 10/2007 Harding
2005/0059537 A1* 3/2005 Hull ..... A63B 21/0004 482/124
2007/0161473 A1* 7/2007 McBride ..... A63B 21/4009 482/105
2011/0021329 A1* 1/2011 Dunne ..... A63B 21/0552 482/124
2014/0200499 A1* 7/2014 Champion ..... A63B 21/4009 602/36
2020/0230462 A1* 7/2020 McKeever ..... A63B 21/4009
2023/0310924 A1* 10/2023 Akkad ..... A63B 21/0442 482/124

* cited by examiner

*Primary Examiner* — Zachary T Moore
(74) *Attorney, Agent, or Firm* — Dale J. Ream

(57) ABSTRACT

A weightlifting apparatus includes a weight belt having a body portion extending between opposed first and second ends. The weight belt includes a strap that extends away from a first end and includes a buckle proximate the second end, said strap and buckle being configured to engage about a weightlifter's waist or released to be removed from the weightlifter's waist. The strap and buckle combination may include hook and loop fasteners, prongs and holes, or a lever buckle configuration. Further, a plurality of fasteners, such as D-rings, may be mounted to sidewalls of the body portion and configured for attachment of auxiliary weightlifting equipment. A multi-segment support pad is positioned on an inner surface of a rear portion of the weightlifting belt to support a lumbar region of the weightlifter's back.

15 Claims, 6 Drawing Sheets

WEIGHTLIFTING APPARATUS

BACKGROUND OF THE INVENTION

This invention relates generally to exercise equipment and, more particularly, to a weightlifting apparatus that includes a lumbar-supporting and comfortable belt that also enables attachment to auxiliary weightlifting devices to provide a full body workout.

Weightlifting belts are frequently used by professional weightlifters and by other athletes who are engaged in heavy lifting or frequent lifting. A weightlifting belt has two primary purposes, namely, to reduce stress on the lower back while the person is lifting in an upright position and to prevent back hyperextension during overhead lifts. A common problem with weight belts is the ability to quickly and adequately tighten the belt to fit tightly in all of the places that need to be protected, especially the lumbar region In another aspect of weight training, the exercise person may desire to do calisthenics, speed training, pull-ups, push-ups, or exercises at odd angles. Although these are excellent exercises, a physically fit athlete may find that these exercises require an inordinately large number of repetitions in order to receive the workout that is desired.

Therefore, it would be desirable for a weightlifting apparatus to facilitate the addition of additional free weights or to be attachable to a parachute or resistance bands such that traditional exercises can be made substantially more difficult and, therefore, more effective to the person working out. Further, it would be desirable to have a weightlifting apparatus that provides an enhanced lumbar support pad for protecting against injury. In addition, it would be desirable to have a weightlifting apparatus that has a buckling mechanism that is convenient and adjustable.

SUMMARY OF THE INVENTION

A weightlifting apparatus according to the present invention includes a weight belt having a body portion extending between opposed first and second ends. The weight belt includes a strap that extends away from a first end and includes a buckle proximate the second end, said strap and buckle being configured to engage about a weightlifter's waist or released to be removed from the weightlifter's waist. The strap and buckle combination may include hook and loop fasteners, prongs and holes, or a lever buckle configuration. Further, a plurality of fasteners, such as D-rings, may be mounted to sidewalls of the body portion and configured for attachment of auxiliary weightlifting equipment. A multi-segment support pad is positioned on an inner surface of a rear portion of the weightlifting belt to support a lumbar region of the weightlifter's back.

Therefore, a general object of this invention is to provide a weightlifting apparatus having a lumbar-supportive weight belt having a plurality of D-ring fasteners to which auxiliary weights and exercise equipment may be attached.

Another object of this invention is to provide a weightlifting apparatus, as aforesaid, having both vertical and horizontal fasteners for enhanced weight training as well as resistance training such as with a parachute or weight bands.

Still another object of this invention is to provide a weightlifting apparatus, as aforesaid, having a multi-part distributed support pad positioned on an inner surface of a rear portion of the weight belt for proper lumbar support.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
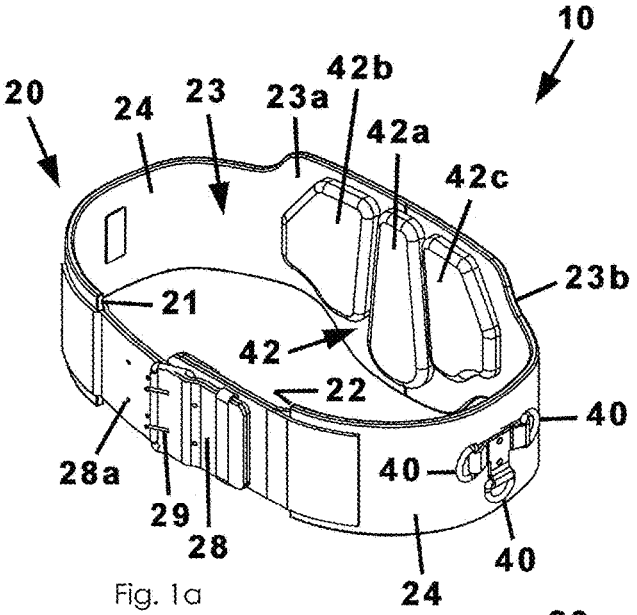
FIG. 1*a* is a perspective view of a weightlifting apparatus according to the present invention.
Figure 1B:
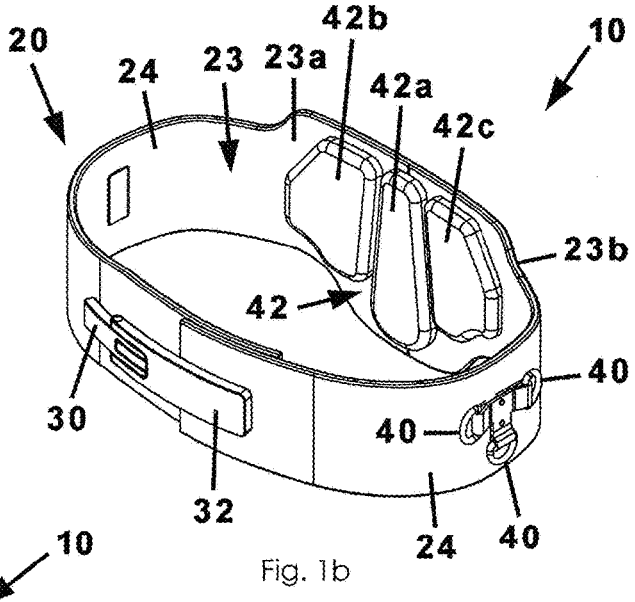
FIG. 1*b* is another perspective view of a weightlifting apparatus according to the present invention.
Figure 1C:
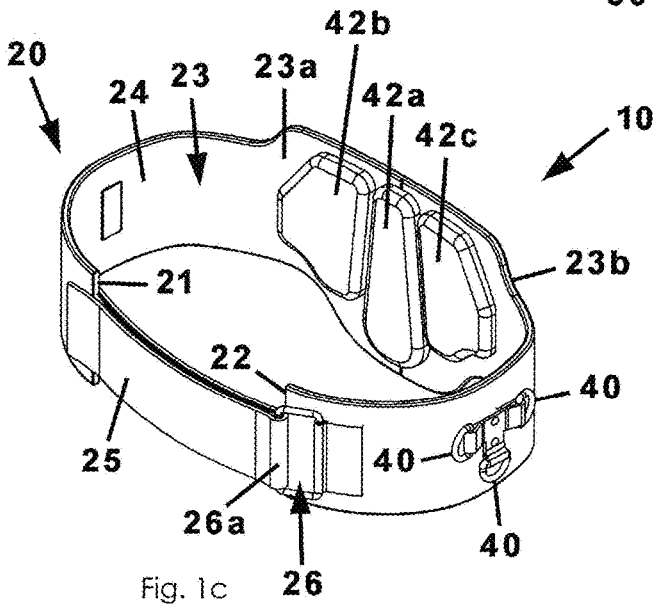
FIG. 1*c* is another perspective view of a weightlifting apparatus according to the present invention.
Figure 2A:
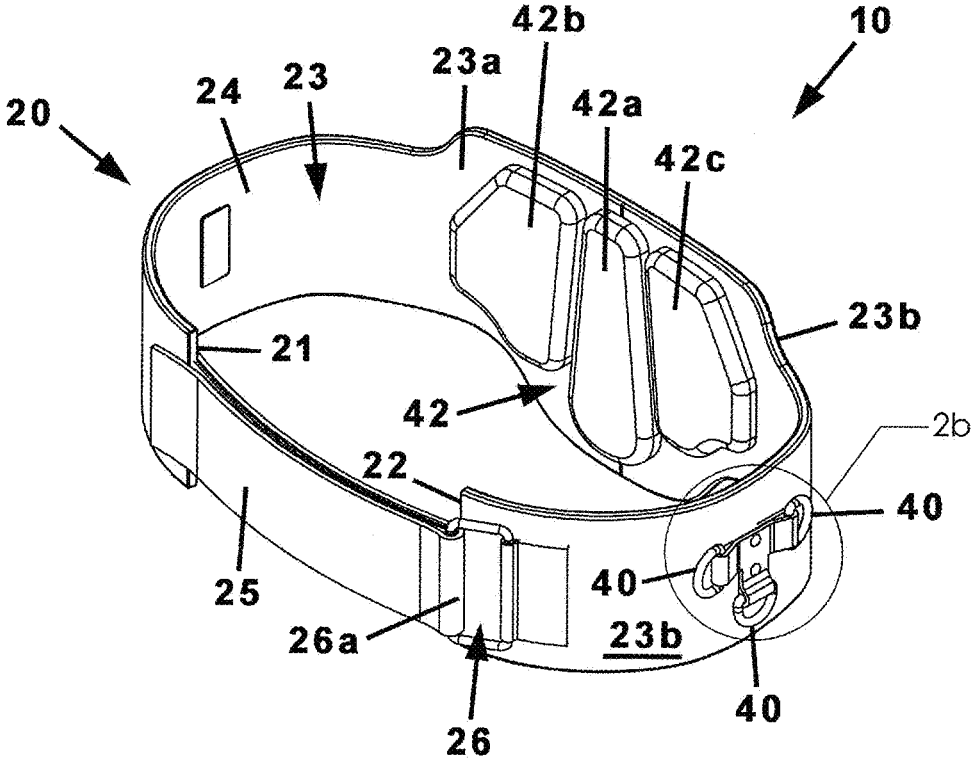
FIG. 2*a* is another perspective view on an enlarged scale of the weightlifting apparatus as in FIG. 1*c;*
Figure 2B:
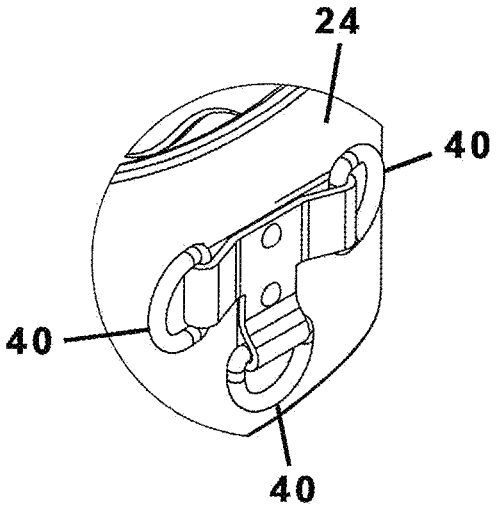
FIG. 2*b* is an isolated view on an enlarged scale taken from FIG. 2*a;*
Figure 3A:
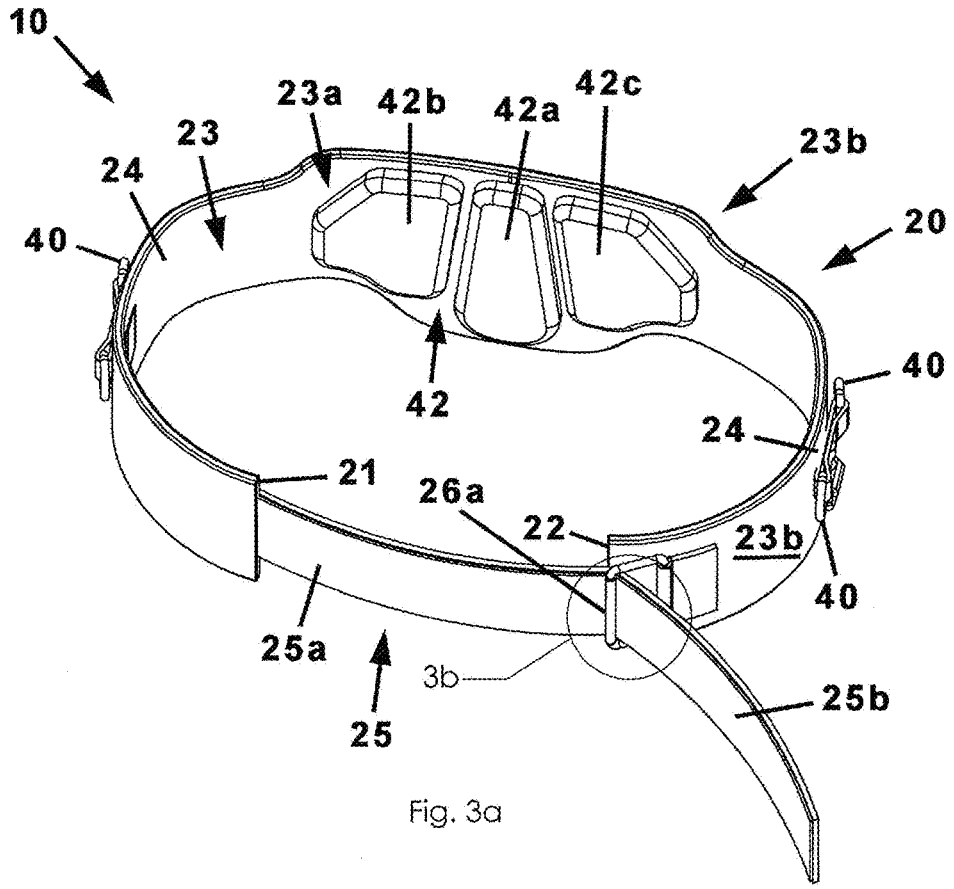
FIG. 3*a* is another perspective you of the weightlifting belt as in FIG. 2*a*, illustrated in and unbuckled configuration.
Figure 3B:
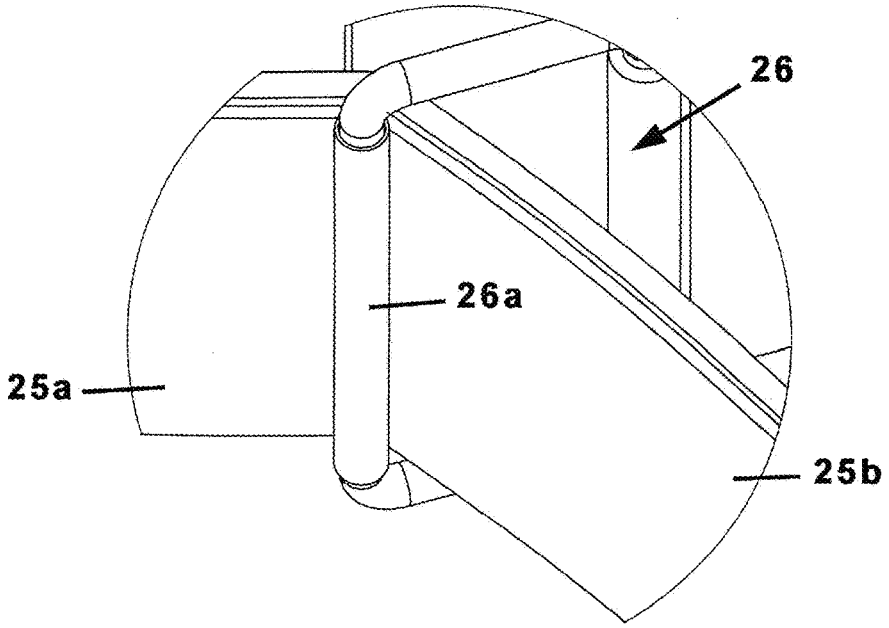
FIG. 3*b* is an isolated view on an enlarged scale taken from FIG. 3*a;*

A weightlifting apparatus according to the present invention will now be described with reference to the accompanying illustrations.

The weightlifting apparatus 10 is an invention intended to be worn about the waist of a weightlifter or any person who wishes to work out using multiple exercise tools while still being supported by wearing a weight belt. For the sake of context, a traditional weight belt is defined as a belt worn about a person's waist that provides support during a lift. In other words, a weightlifting belt is not intended to hold up any article of clothing but, rather, is intended to prevent injury to a person lifting weights. The first aspect regarding a weight belt is how to secure it around one's waist. Because of the length of time a person will wear the weight belt, attachment and comfort are essential considerations. And, the reality that a weight belt is intentionally wider and thicker than a traditional clothing belt often results in portions of the belt digging into the skin of the weightlifter and becoming uncomfortable or even painful. In addition, it is important for a weight belt to be tightly secured about the weightlifter's waist so as to hold and even press against the weightlifter's muscles and skeletal system (such as a lumbar region of one's back) securely and, as a result, to prevent injury.

In the present invention, therefore, a weight belt 20 portion of the weightlifting apparatus 10 may include a first end 21 and a second end 22 that is opposite and displaced from the first end 21. For the sake of clarity, a body portion 23 extends between the opposed ends 21 and 22, respectively, the body portion 23 defining an inner surface 23*a* and an outer surface 23*b* and includes a pair of opposed sidewalls 24. The sidewalls 24 are important for reasons that will be discussed in greater detail later. Preferably, the body portion 23 of the weightlifting belt 20 is constructed of cowhide leather and stretch lambskin. It is understood that stretch lambskin refers to the highest quality lamb leather in combination with an elastic material.

Further describing the weightlifting belt 20, the body portion 23 includes a back support section 23*a* having a generally rectangular configuration that includes gently rounded corners and that defines a vertical dimension that is greater than a vertical dimension of the sidewalls 24 and strap 25. In fact, the back support section 23*a* is opposite the strap 25 such that the back support section 23*a* may be aligned upon a person's back while the strap 25 is aligned with a person's front/abdomen. Stated another way, the back support section 23*a* is generally flat but may be configured to conform to the normal curvature of a person's lumbar or lower back region. A support pad 42 may be coupled to an inner surface of the back support section 23*a* and positioned to overlay and apply pressure upon specific muscle or skeletal components of a weightlifter's body in order to prevent injury or simply to provide comfort thereto.

Described in more detail, the weightlifting apparatus 10 includes a support pad 42 mounted, such as by sewing, to the inner surface of the back support section 23*a* of the body portion 23 at about a midpoint between the first end 21 and second end 22 of the weightlifting belt 20. Preferably, the support pad 42 includes multiple sections (shown as 3 sections) each being laterally displaced from one another so as to bear against and support the lumbar region of the weightlifter's lower back when the weightlifting belt 20 is worn about the waist of a weightlifter.

More particularly, the support pad 42 includes a center pad portion 42*a*, a left pad portion 42*b*, and a right pad portion 42*b*—each pad being separate and spaced apart from any other pad and being specifically configured and positioned to correspond to specific muscle or skeletal systems of a human body when the weightlifting apparatus 10 is worn about the waist of a person. In an exemplary embodiment, the center pad portion 42*a* extends vertically between upper and lower edges of the back support section 23*a* of the body portion 23 and is positioned at a midpoint between first and second ends 21, 22. Preferably, the center pad portion 42*a* has a truncated-triangular configuration that is specifically positioned to bear against or receive the tailbone 100 (also referred to as the coccyx) and Erector Spinae muscle 101 of a person wearing the weightlifting belt 20 around his waist. It is understood that the application of pressure against a weightlifter's tailbone 100 and related muscles can prevent injury thereto during weightlifting exercises.

Similarly, the left pad portion 42*b* and right pad portion 42*c* may be positioned laterally spaced apart relative to the center pad portion 42*a*. The left and right pad portions may each have a frusto-rectangular (rectangle-like) shape configuration that conforms to the transition from the back support section 23*a* to the sidewalls 24. Further, the left and right pad portions are shaped and positioned to put pressure upon the left and right internal oblique muscles 102, respectively, which are located in the lumbar region (i.e., low back) of a human body when the weightlifting belt 20 is worn about the user's waist.

Figure 4:
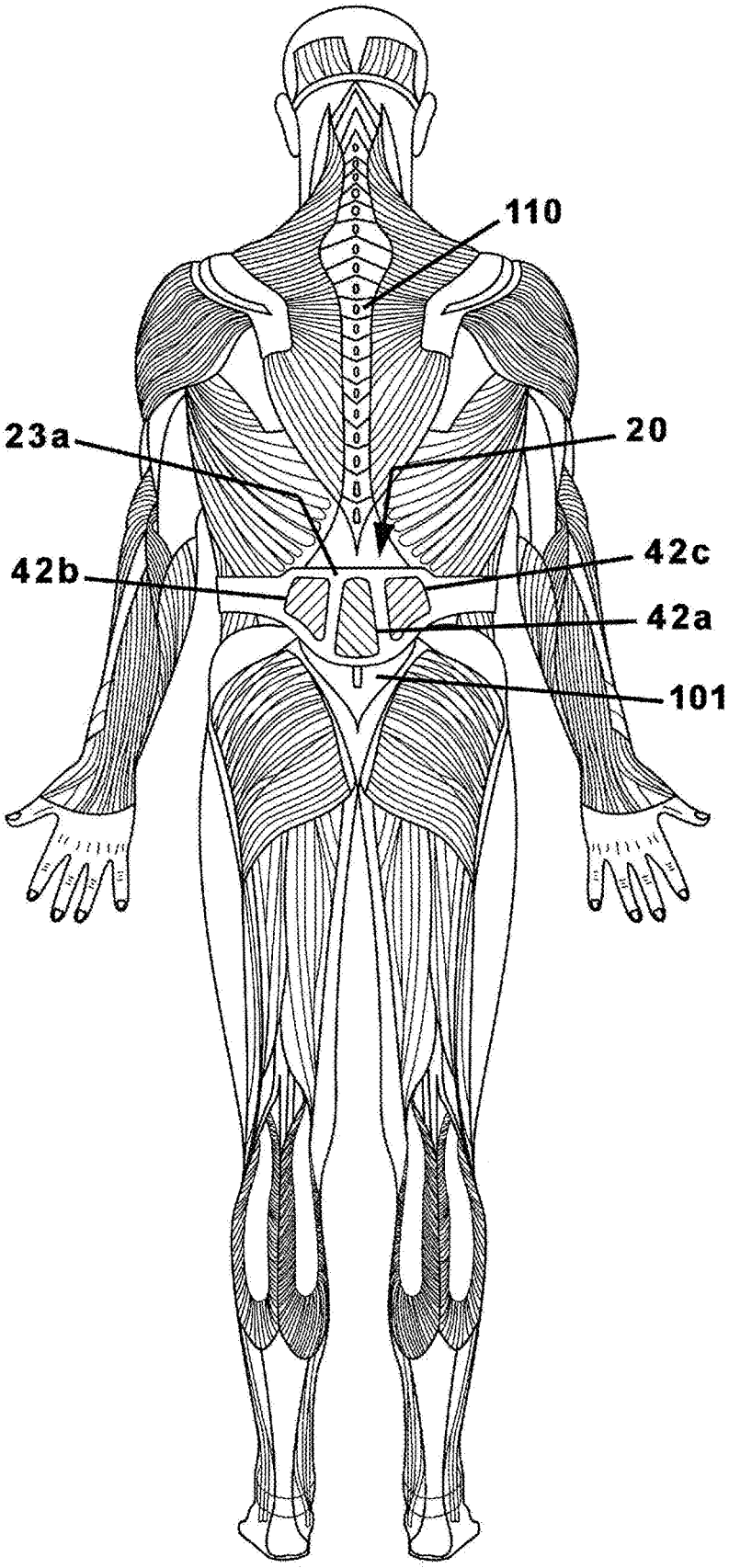
FIG. 4 is a diagram illustrating muscle groups located on a backside of a person illustrated from head to toe.
Figure 5:
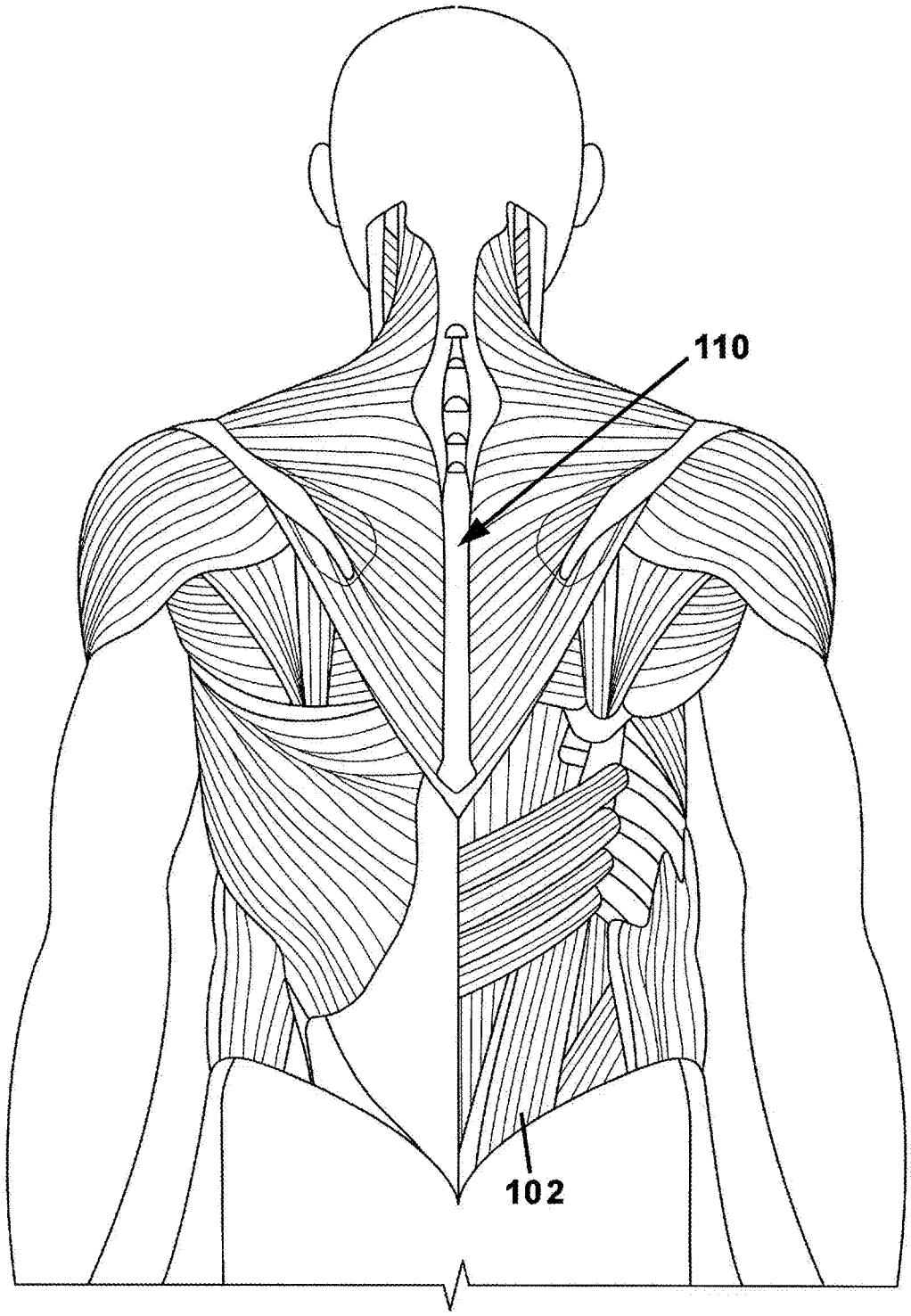
FIG. 5 is a diagram illustrating muscle groups located on a person's back and lumbar region.
Figure 6:
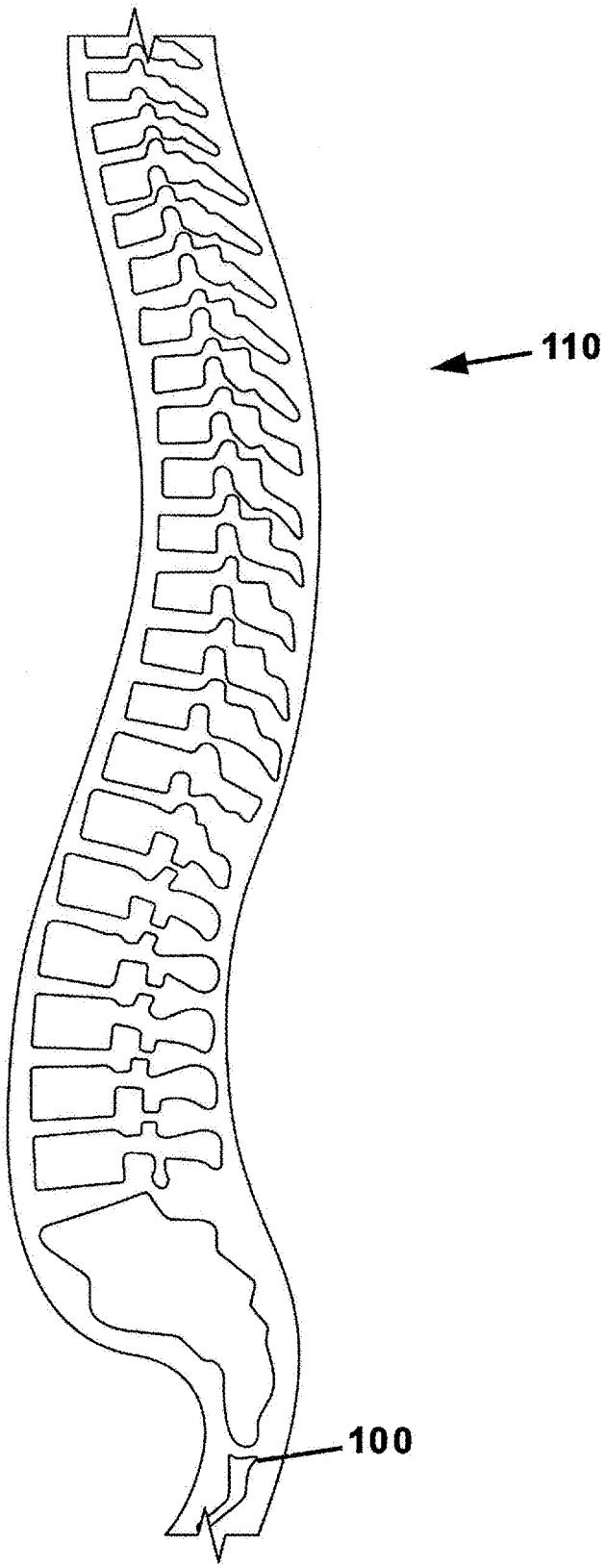
FIG. 6 is a diagram illustrating a spinal column of a person.

The specific muscles and spinal bones described in this paragraph are illustrated in FIGS. 4 to 6 of the accompanying drawings. Further to the description above, the tailbone 100 or coccyx is a skeletal structure formed at the lowermost position of a person's spinal column 110 as shown in FIG. 6. When the weight belt 20 is worn about the waist of a weightlifter (as shown diagrammatically in FIG. 4), the center pad portion 42*a* is configured to receive the tailbone 100 or, stated another way, applies pressure against the tailbone 100 and Erector Spinae muscle 101. Similarly, FIGS. 4 and 5 depict the left and right internal oblique muscles 102. When the weight belt 20 is more about the waist of a weightlifter (as shown diagrammatically in FIGS. 4), the left and right pad portions 42*b* and 42*c* are positioned and configured to receive the internal oblique muscles 102, stated another way, apply pressure against that muscles so as to prevent injury thereto.

It is understood that it is critical that the support pad portions are positioned as described and shown in the present application so as to provide support and to prevent injury to the lumbar region of a weightlifter in ways never before known or attempted in a weight belt or any other weightlifting apparatus.

Specifically, the support pad 42 is manufactured using Luxury Firm Foam which is durable and holds its shape for years and is preferred over traditional foam. Further, each section of the support pad 42 may be covered with a layer of polyvinyl chloride (PVC) which provides sufficient protection to the foam and prevents it from being corrupted by sweat or contact by the user.

In a critical aspect, the weight belt 20 may be secured about the waist of the weight lifter via a strap mechanism. Specifically, the strap mechanism may be manipulated and coupled together to secure the weight belt about the waist of a person or may be manipulated and released so that the weight belt 20 may be removed, such as for storing or simply because the workout is completed. In any case, the weight belt 20 may include at least one strap 25 extending from the first end 21 for selective attachment to a buckle 26 mounted adjacent the second end 22. As described above, the strap 25 is positioned opposite the back support section 23*a*.

In one embodiment, the at least one strap 25 has an elongate construction so that it folds back on itself so as to provide almost an infinite degree of adjustment, whether tightening or loosening. More particularly, the at least one strap 25 may include a first section 25*a* constructed entirely or substantially out of a hook material (hook material being one configuration of a hook and loop material such as is marketed under the brand name Velcro®). Similarly, the at least one strap 25 may include a second section 25*b* constructed entirely or substantially out of a loop material. Preferably, the sections are aligned one after the other in linear configuration. In this embodiment, the buckle 26 is a roller buckle 26*a* having a cylindrical and linear configuration about which the at least one strap 25 may be "redirected." In other words, the first section 25*a* is extended from the first end 21 to the roller buckle 26*a* and wrapped around it such that the second section 25*b* extends in a reverse direction, i.e., back in the direction of the first end 21. The second section 25*b* can be cinched or tightened as tight as the wearer desires and then the sections are merely pressed together so as to engage the hook and loop materials.

In an embodiment, strap 25 will be referred to as a tongue 28 which defines a plurality of holes 28*a*, the plurality of holes being spaced apart from one another along the longitudinal extent of the tongue 28. It is understood that the plurality of holes 28*a* may be organized in a double wide configuration as is the case in some belts or may be arranged in a single wide configuration like standard apparel belts. Further, the buckle includes one or a pair of prongs 29 configured for insertion into a selected hole or holes, respectively. Stated another way, the tongue 28 may be stretched away from the first end 21 until the prongs 29 become aligned with respective holes 28*a* such that the weightlifting belt 20 feels tight and secure about the weightlifter's waist.

In another embodiment, reference will also be made to the at least one strap 25 being a tongue 28 having a lever buckle that includes a clasp 30 that is complementary to a predetermined number of apertures 31 defined at a free end of a second strap 32. It is understood that the positions of the clasp can be arranged or configured according to the waist size of the weightlifter and this can be done prior to donning the weightlifting belt 20. In use, the tongue 28 may be stretched until the clasp 30 is received into the apertures 31. The lever buckled includes a lever 32 which may be actuated (pivoted) to secure closure.

In another aspect that is critical, the weightlifting apparatus 10 includes a plurality of fasteners securely coupled to each sidewall 24 of the body portion 23 of the weightlifting belt 20. Preferably, each fastener is a D-ring fastener 40. For the sake of clarity, it will be noted that the body portion defines an imaginary longitudinal axis that runs horizontally in parallel with the waist of a user. Accordingly, a pair of the D-ring fasteners 40 are positioned in a back-to-back arrangement in-line and along the imaginary longitudinal axis with another D-ring fastener 40 positioned in a direction that is perpendicular to the imaginary longitudinal axis. In other words, two fasteners may be positioned in a vertical orientation to which free weights may be attached and one fastener may be oriented horizontally for connection to resistance bands or even the cords of a parachute (not shown). In fact, in an exemplary application, chains (not shown) may be coupled to the pair of D-ring fasteners 40 and then free weights coupled to free ends of the chains, respectively, such that the user lifts the entire weight thereof when wearing the weightlifting belt 20. Preferably, each group of three fasteners may be coupled together with a sturdy plastic material and mounted to the body portion 23 with industrial-strength rivets. It is understood that each D-ring fastener 40 may be constructed of a metal so as to be durable and sturdy enough for securing resistance and other exercise equipment.

It is understood that while certain forms of this invention have been illustrated and described, it is not limited thereto except insofar as such limitations are included in the following claims and allowable functional equivalents thereof.

The invention claimed is:

1. A weightlifting apparatus to be worn about the waist of a weightlifter, comprising:

a weight belt having a first end and a second end opposite said first end and having a body portion extending between said first and second ends, said body portion having inner and outer surfaces and a pair of opposed sidewalls, said weight belt including at least one strap extending from said first end, said weight belt including a buckle proximate said second end that is configured to selectively engage or release said at least one strap such that said weight belt is secured to or removed from the waist of the weightlifter, respectively;

a support pad mounted to the inner surface at a midpoint between said first end and said second end, said support pad having a plurality of portions distributed laterally so as to support a lumbar region of the weightlifter when said weight belt is worn thereby;

each sidewall of the pair of sidewalls comprising a plurality of D-rings each configured to engage additional weightlifting devices, wherein each of said plurality of D-rings include a pair of D-rings extending in opposite directions along a respective longitudinal axis defined by said body portion of said weight belt; and wherein each of said plurality of D-rings includes an auxiliary D-ring coupled to said respective pair of D-rings and extending perpendicularly to said respective longitudinal axis.

2. The weightlifting apparatus as in claim 1, wherein:

said buckle is a roller buckle and is fixedly attached to said second end; and said at least one strap has an elongate construction and includes a first section constructed of a hook material and a second section constructed of a loop material such that said at least one strap is configured to wrap around said roller buckle such that said second section is coupled to said first section in an infinitely adjustable engagement.

3. The weightlifting apparatus as in claim 1, wherein:

said at least one strap is a tongue that defines a plurality of holes spaced apart from one another along a longitudinal extent thereof; and said buckle includes at least one prong configured for insertion into a respective hole of said plurality of holes so as to secure said weight belt about the waist of the weightlifter.

4. The weightlifting apparatus as in claim 1, wherein:

said at least one strap is a tongue extending away from said first and defining a predetermined number of apertures adjacent a free end; and said buckle is a lever buckle having a clasp mounted to said second end and configured for selective receipt in said predetermined number of apertures and having a lever for securing said clasp to said predetermined number of apertures when actuated.

5. The weightlifting apparatus as in claim 1, wherein said support pad is constructed of Luxury Firm Foam material that is characterized for being durable, said support pad being covered by a layer of polyvinyl chloride (PVC).

6. The weightlifting apparatus as in claim 1, wherein said body portion of said weight belt is constructed of cowhide leather and stretch lambskin.

7. The weightlifting apparatus as in claim 1, wherein said plurality of D-rings are attached to said pair of sidewalls using rivets and are durable for attachment to elastic weight bands, chains, and free weights.

8. A weightlifting apparatus to be worn about the waist of a weightlifter, comprising:

a weight belt having a first end and a second end opposite said first end and having a body portion extending between said first and second ends, said body portion having inner and outer surfaces and a pair of opposed sidewalls;

a support pad mounted to the inner surface of a back support section of said body portion at a midpoint between said first end and said second end, said support pad having a plurality of pad portions each being laterally displaced from one another and configured so as to bear against a lumbar region of the weightlifter 9 when said weight belt is worn thereby; and each sidewall of the pair of sidewalls comprising a plurality of D-rings each configured to engage additional weightlifting devices, wherein each of said plurality of D-rings include a pair of D-rings extending in opposite directions along a respective longitudinal axis defined by said body portion of said weight belt; and wherein each of said plurality of D-rings includes an auxiliary D-ring coupled to said respective pair of D-rings and extending perpendicularly to said respective longitudinal axis;

wherein said weight belt includes (1) at least one strap extending from said first end and (2) a buckle proximate said second end that is configured to selectively engage or release said at least one strap such that said weight belt is secured to or removed from the waist of the weightlifter, respectively.

9. The weightlifting apparatus as in claim 8, wherein said plurality of D-rings is attached to said pair of sidewalls using rivets and is durable for attachment to elastic weight bands, chains, and free weights.

10. The weightlifting apparatus as in claim 8, wherein:

said buckle is a roller buckle and is fixedly attached to said second end; and said at least one strap has an elongate construction and includes a first section constructed of a hook material and a second section constructed of a loop material such that said at least one strap is configured to wrap around said roller buckle such that said second section is folded back upon and releasably coupled to said first section in a hook and loop engagement that is infinitely adjustable.

11. The weightlifting apparatus as in claim 8, wherein:

said at least one strap is a tongue that defines a plurality of holes spaced apart from one another along a longitudinal extent thereof; and said buckle includes at least one prong configured for insertion into a respective hole of said plurality of holes so as to secure said weight belt about the waist of the weightlifter.

12. The weightlifting apparatus as in claim 8, wherein:

said at least one strap is a tongue extending away from said first and defining a predetermined number of apertures adjacent a free end; and said buckle is a lever buckle having a clasp mounted to said second end and configured for selective receipt in said predetermined number of apertures and having a lever for securing said clasp to said predetermined number of apertures when actuated.

13. The weightlifting apparatus as in claim 8, wherein:

said support pad is constructed of Luxury Firm Foam material that is durable, said support pad being covered by a layer of polyvinyl chloride (PVC); and said body portion of said weightlifting belt is constructed of cowhide leather and elastic.

14. The weightlifting apparatus as in claim 8, wherein said plurality of pad portions includes:

a center pad portion positioned at a midpoint of the back support section of the body portion and configured to apply pressure to a coccyx and erector spinae muscle of a person wearing the weight belt;

a left pad portion positioned laterally adjacent said center pad section and configured to apply pressure to a left side internal oblique muscle of the person wearing the weight belt; and a right pad portion laterally adjacent said center pad section and configured to apply pressure to a right side internal oblique muscle of the person wearing the weight belt.

15. The weightlifting apparatus as in claim 14, wherein:

said center pad portion has a truncated-triangular configuration extending vertically between upper and lower edges of the back support section of the body portion so as to be complementary to a lower region of a person's spine of the person wearing the weight belt; and said left pad portion and said right pad portion each define a frusto-rectangular shape configuration that conforms to a transition area that is intermediate the back support section and the sidewalls of the body portion, said left and right pad portions having a configuration that is complementary to the left and right internal oblique muscles of the person wearing the weight belt.

* * * * *